US006019486A

United States Patent [19]

Stewart, Jr.

[11] Patent Number: 6,019,486

[45] Date of Patent: Feb. 1, 2000

[54] LIGHTING DEVICE

[76] Inventor: Clyde E. Stewart, Jr., 1324 Holloway Dr., Apt. 81, Plymouth, Ind. 46563

[21] Appl. No.: 08/504,890

[22] Filed: Jul. 20, 1995

[51] Int. Cl.[7] ..... F21P 1/02

[52] U.S. Cl. ..... 362/362; 362/219; 362/812; 40/573

[58] Field of Search ..... 362/362, 219, 362/396, 812; 40/573; 439/56, 212, 213

[56] References Cited

U.S. PATENT DOCUMENTS

| | | | |
|---|---|---|---|
| 1,782,564 | 11/1930 | Coufal et al. | 362/812 |
| 1,844,097 | 2/1932 | Luhman | 40/573 |
| 3,155,324 | 11/1964 | Chen | 362/219 |
| 4,340,929 | 7/1982 | Konikoff et al. | 362/153 |
| 4,532,579 | 7/1985 | Merryman | 362/239 |
| 4,631,648 | 12/1986 | Nilssen | 362/219 |
| 4,754,380 | 6/1988 | Wang | 362/244 |
| 5,446,634 | 8/1995 | Okubo | 362/362 |

*Primary Examiner*—Alfred Basichas
*Attorney, Agent, or Firm*—Baker & Daniels

[57] ABSTRACT

A lighting device for displaying addresses, advertising indicia and other information includes modular housing which may be connected together to form various shapes. An insulating board is mounted in each of the modular housing and has upper and lower surfaces carrying electrically conductive material, with the board providing an insulating layer therebetween. Clips carrying electrical conductors interconnect the conductive materials on the board of adjacent housings. Electricity is transmitted through a clip to the board of one of the housings to provide illumination to illuminate the devices mounted on the boards in each housings.

7 Claims, 5 Drawing Sheets

LIGHTING DEVICE

This invention relates to a lighting device.

Lighting devices of the type disclosed herein may be used at homes to display addresses, to illuminate walkways and driveways, to provide an emergency signal to assist emergency vehicles in finding an address, to display school or sport team indicia, or to display advertising indicia. Lighting devices of the type disclosed herein may also be used in automobiles for similar purposes. The lighting devices include modules or housings which include a translucent cover for displaying indicia. Each module is provided with its own illuminating device, and the modules may be made in various shapes. The modules can be secured together to provide maximum flexibility when creating displays. The modules consist of a housing having side walls and top and bottom panels, at least one of which is translucent. If both the top and bottom panels are translucent, indicia such as house addresses can be displayed for viewing in both directions of travel. The modules may be secured together and then displayed in any convenient manner, such as hanging from a wall or ceiling, mounting in a window of a home or in an automobile or store window, or displayed on a lawn. A prior art lighting device is disclosed in U.S. Pat. No. 4,532,579.

According to the invention, each module includes a housing with a printed circuit board mounted in the housing and suspended away from the walls thereof. The printed circuit board circumscribes the housing, and is provided with conductive material on opposite surfaces of the circuit board, with the board providing an insulative layer therebetween. The modules are interconnected by electrical connectors that carry electric current between the conductive surfaces of the circuit boards of the modules. One of the connectors is connected to a line cord for connection to a source of electrical energy. Accordingly, the modules may be quickly and easily connected together in any of several configurations. Clips are also provided for interconnecting the housings to secure them together.

These and other advantages of the present invention will become apparent from the following description, with reference to the accompanying drawings, in which.

Figure 1:
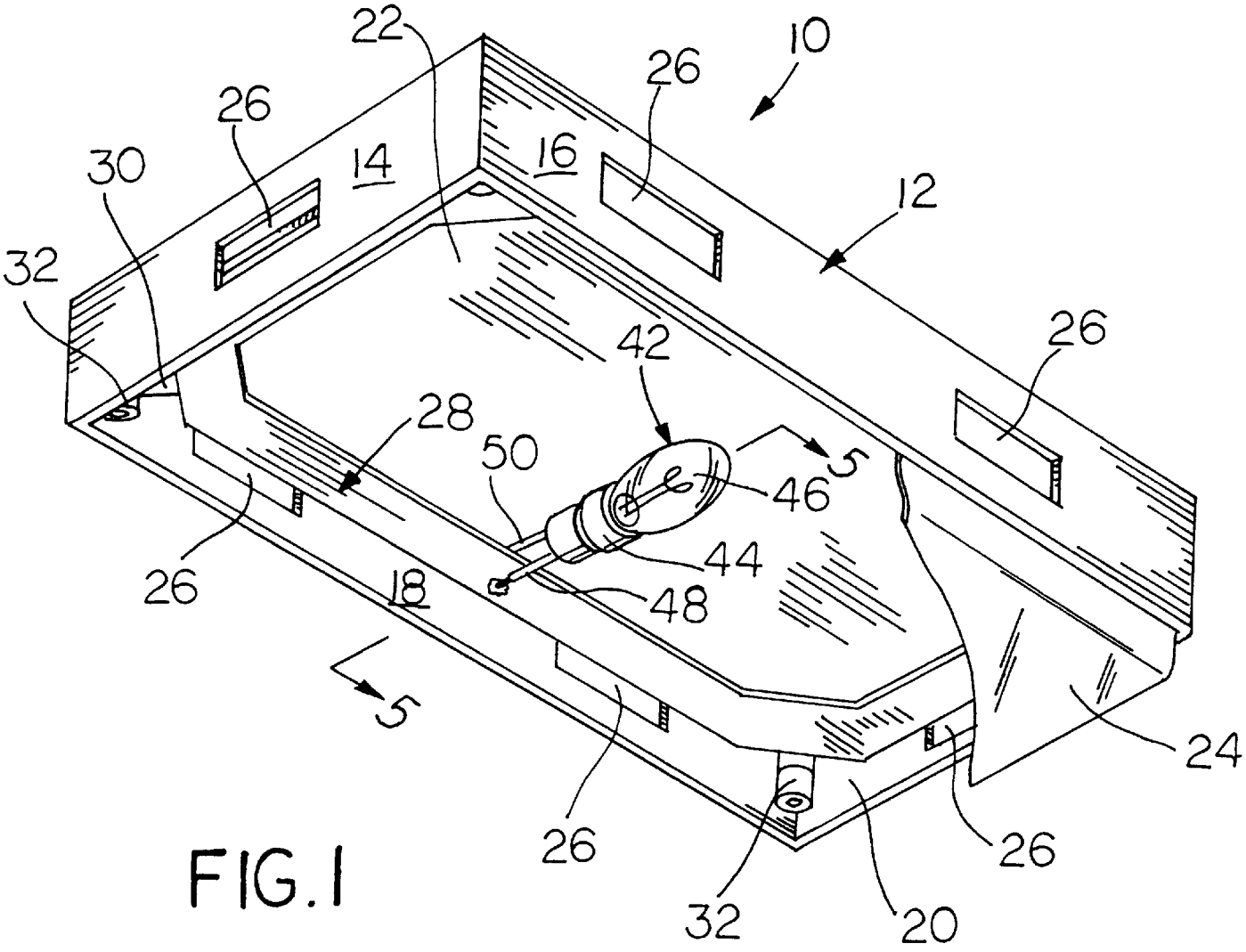
FIG. 1 is a view in perspective of one module of a lighting device made according to the present invention with the top translucent panel thereof broken away to show the internal components thereof.

Referring now to the drawings, a lighting device generally indicated by the numeral 10 includes a module or housing 12 consisting of side walls of 14, 16, 18 and 20, a bottom wall 22 and a translucent top wall 24. Each of the side walls 14–20 is provided with knock-outs to form apertures in the side wall as desired as generally indicated at 26. A perimetrically extending conductive member generally indicated by the numeral 28 extends generally parallel to the side walls 14–20 and is supported away from the walls 14–24 by arms 30 extending from posts 32 in each corner of the module or housing 12.

Figure 5:
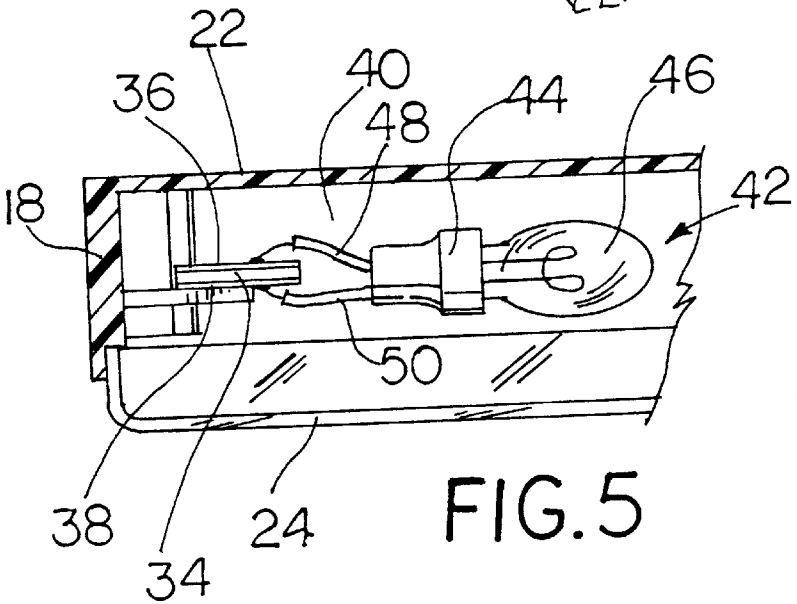
FIG. 5 is a fragmentary cross-sectional view taken substantially along line 5—5 of FIG. 1.
Figure 6:
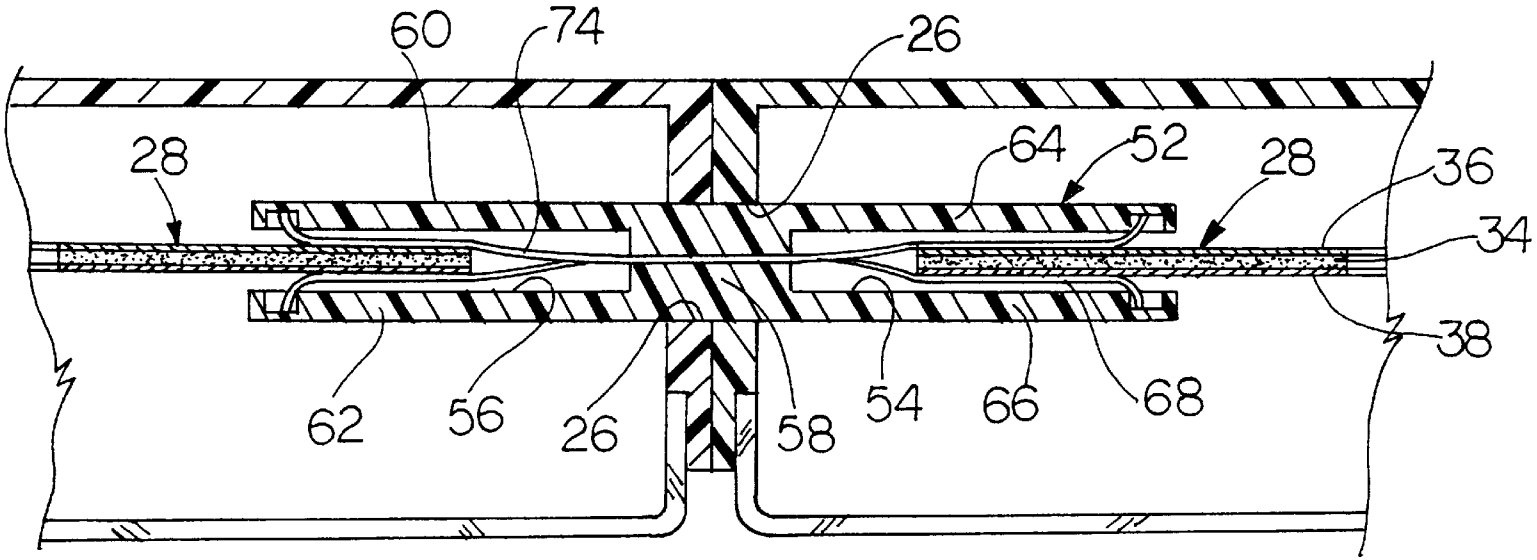
FIG. 6 is a view taken substantially along line 6—6 of FIG. 2.

Referring now more particularly to FIGS. 1, 5 and 6, the conductive member 28 is a conventional printed circuit board in which the board forms an insulating layer 34 which is coated with a conductive material 36 on one side thereof and a conductive material 38 on the opposite side thereof. The board 34 thereby electrically insulates the conductive material 36 from the conductive material 38. The conductive member 28 circumscribes an area 40 which is open and which receives an illuminating device generally indicated by the numeral 42, consisting of a socket 44 which supports a conventional light bulb 46. Leads 48, 50 extending from the socket 44 are soldered to the conductive material 36, 38 respectively.

Figure 2:
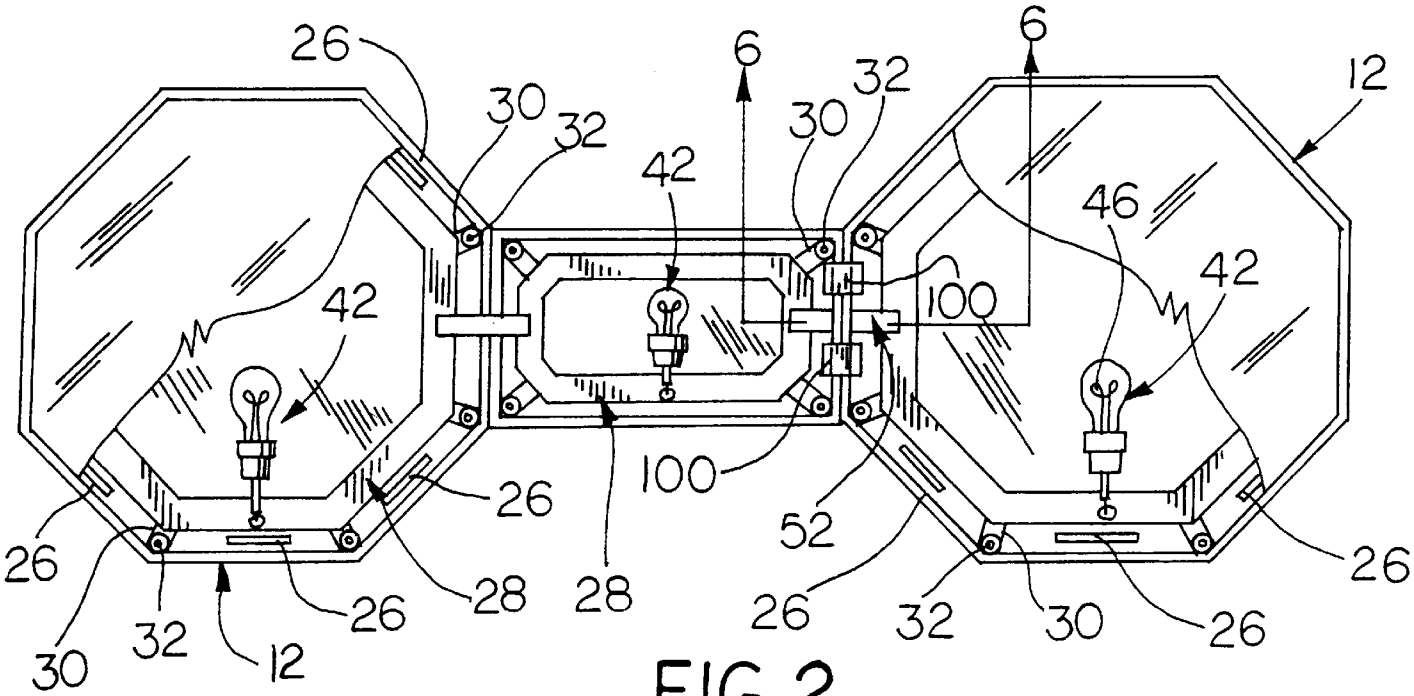
FIG. 2 is a view of three modules of lighting devices made according to the teachings of the present invention connected together, with the top panels of each broken away to illustrate internal components thereof.
Figure 7:
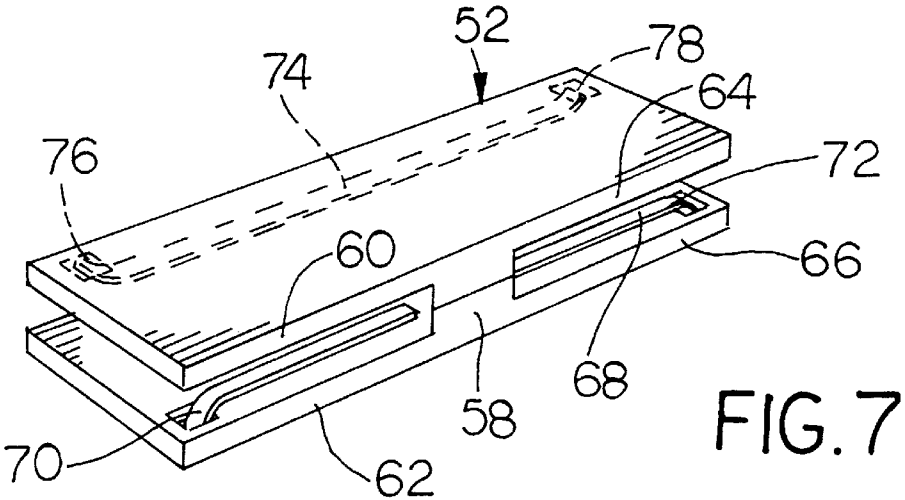
FIG. 7 is a view in perspective of the electrical connector illustrated in FIGS. 2 and 6 which interconnect the electrical conductors used in the connected modules.
Figure 9:
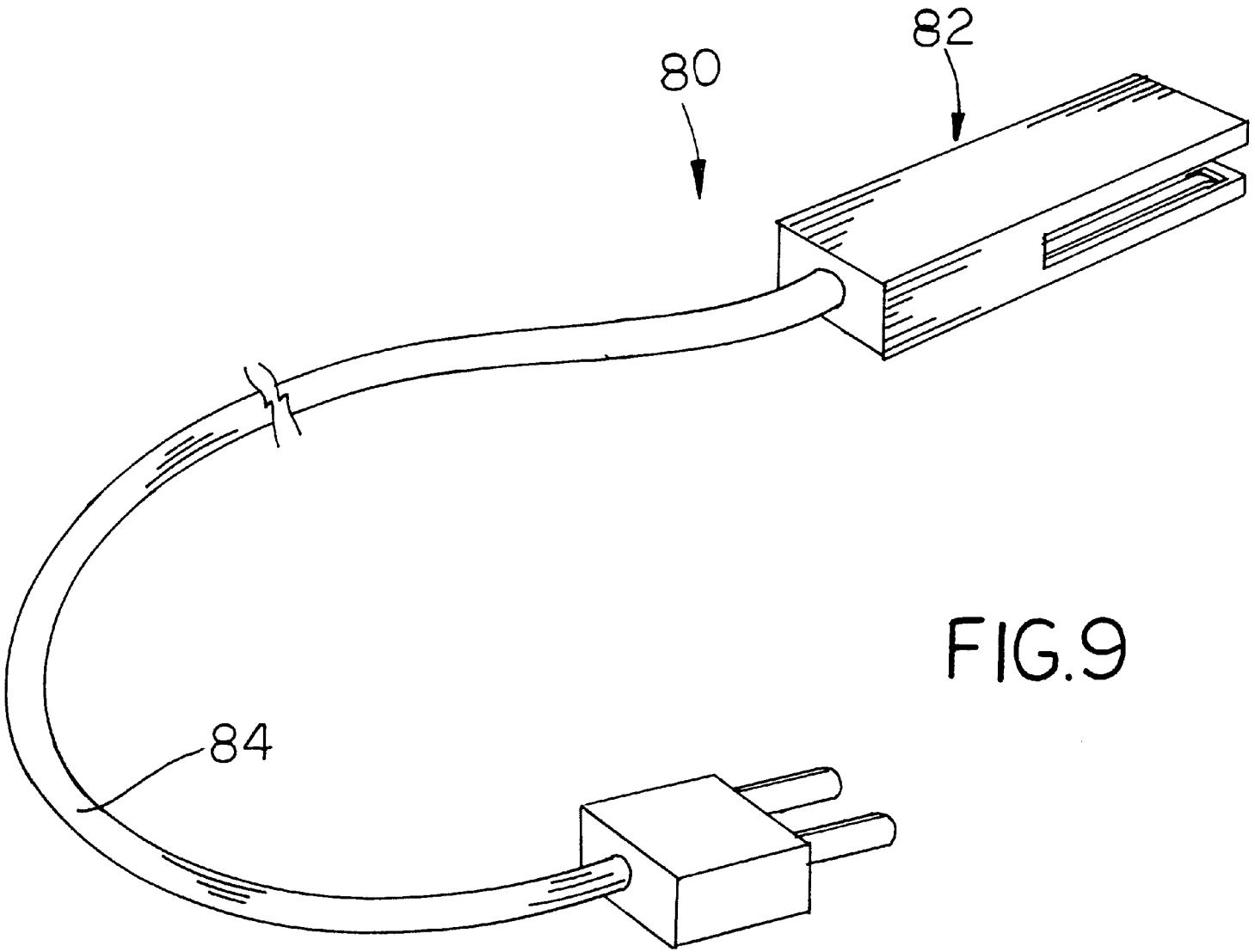
FIG. 9 is a view in perspective of an electrical and line cord used to connect lighting modules to a source of electrical energy.

As most clearly shown in FIGS. 2 and 6, each of the modules 12, which can be virtually any shape such as rectangular (FIG. 1), octagonal (FIG. 2), or having a straight and a curved side (FIG. 4) and may be electrically connected to an adjacent module to form a sign by use of a connector generally indicated by the numeral 52 (FIG. 7). The connector 52 includes slots 54, 56 at opposite ends thereof which are separated by a connecting portion 58 between the ends of the slots 54, 56. The solid portion 58 gives the connector rigidity and is the portion of the connector that extends through the apertures 26 of adjacent housing modules. The connector 52 includes upper and lower arms 60, 62 that define the groove 56 and upper and lower arms 64, 66 define the groove 54. A conductive strip 68 is supporting connective portion 58 and has opposite ends 70, 72 that are received in apertures in the arms 62 and 66 respectively. Another conductive strip 74 is supported in the connective portion 58 and has end portions that are received with slots 76, 78 of the arms 60 and 64 respectively. Accordingly, when the connector 52 is installed as illustrated in FIG. 6, the conductive strip 68 provides electrical connection between the conductive surface 38 on the board 34 and the strip 74 provides an electrical connection between the conductive surfaces 36 on the opposite surfaces of the board 34. Accordingly, by use of the connectors 52, electricity can be transmitted between any number of different modules 12 lighting device 10. Electrical energy is transmitted to one of the modules by use of the connector and line cord generally indicated by the numeral 80 in FIG. 9. The connector 82 is essentially one half of the connector illustrated in FIG. 7, with the leads of the line cord 84 attached to the corresponding conducts 68 and 74. The connector 82 can then be installed through any of the apertures 26 and connected to any of the conductive members 28, and electrical energy is transmitted between the modules by the connector 52. Accordingly, by connection of any one of the modules with the source of electrical energy, all of the modules or housings 12 may be powered.

Figure 3:
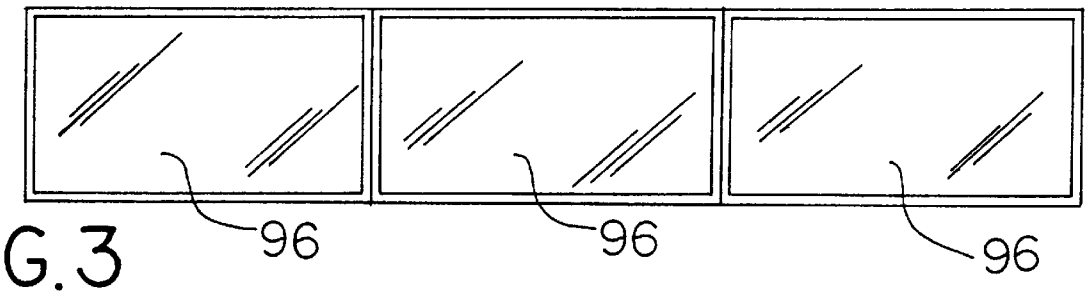
FIG. 3 illustrates the manner in which three rectangular modules of the lighting device of the present invention can be interconnected to form a display.
Figure 8:
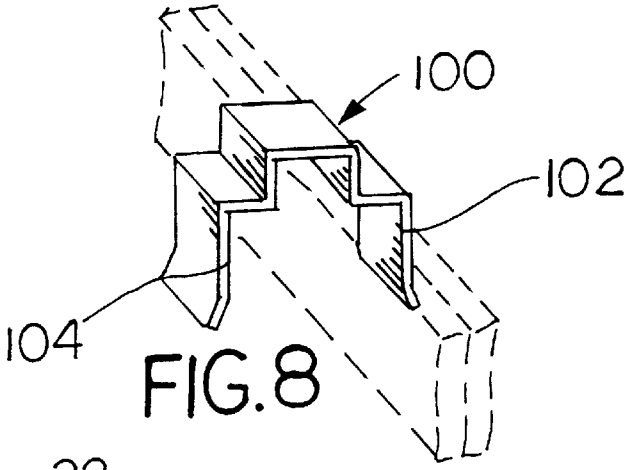
FIG. 8 is a view in perspective of the clip used to hold lighting modules together, with the wall of one such module illustrated in phantom.
Figure 4:
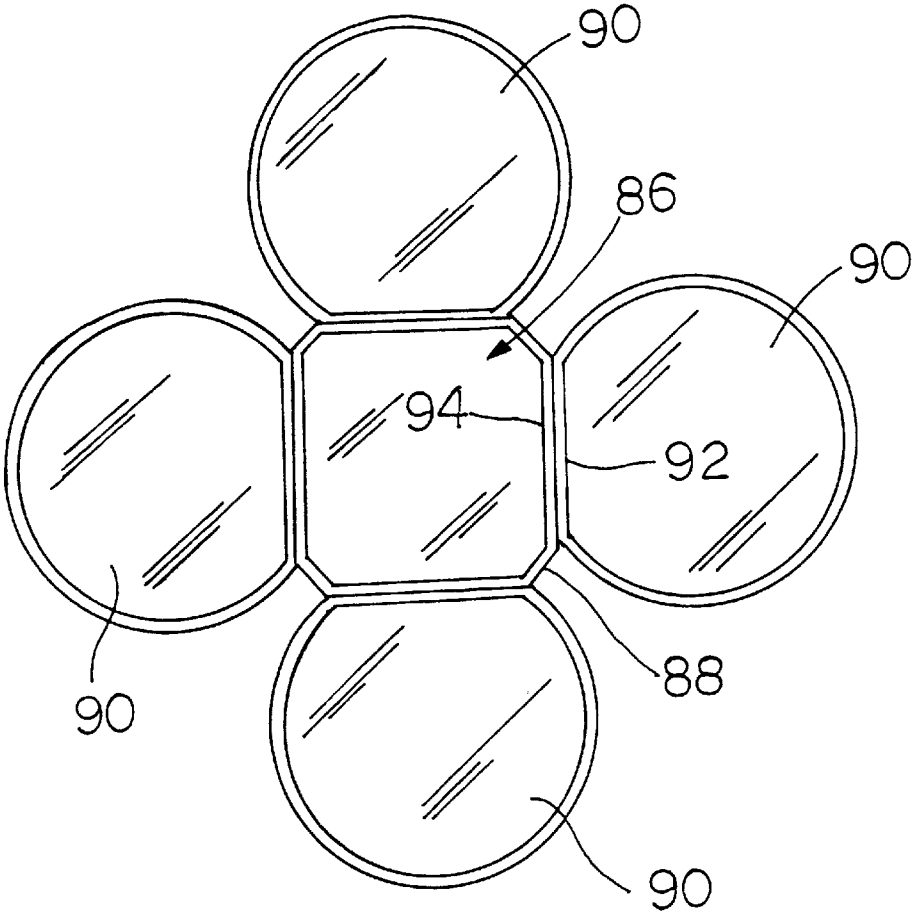
FIG. 4 illustrates the manner in which modules having shapes other than rectangular may be connected together to form a display.

It will also be noted that different modules can be connected together to form an attractive and different lighting display. For example, as illustrated in FIG. 2, two octagonal modules are interconnected by rectangular module. Referring to FIG. 4, a substantially square module 86 with beveled edges 88 re connected to four identical modules 90. It will be noted that each of the modules 90 have one straight side 92 for engagement with a corresponding straight side 94 of the substantially square module 86, but the module 90 otherwise are curved, thus providing a decorative and unusual appearance. Each of the modules 86, 90, of course, have an internal conductive member of the same time as the connective member 28, but shaped to conform to the perimeter of the module. Modules are electrically connected by connectors 52 and one held together mechanically by clips 100. Each clip 100, as illustrated in FIG. 8, include a pair of spring legs 102, 104, which engage the sidewalls of adjacent modules 12, and indicated in FIG. 2, to secure the modules together. Each of the modules 86, 90 are provided with illuminating devices, such as bulbs, which are connected to the corresponding conductive member in exactly the same way as illustrated in FIGS. 1 and 5. Referring to FIG. 3, modules 96, which are identical rectangular modules substantially the same as module 12, are connected together end to end to form a pleasing and attractive advertising or numerical Display. It is also within the scope of the invention to make both the top surface 24 and the bottom surface 40 of translucent material, so that addresses or other advertising indicia may be placed upon both sides of the module, thereby permitting reading by travelers in opposite directions.

I claim:

1. Lighting device comprising a housing, an insulating board mounted in said housing having upper and lower surfaces carrying electrically conductive material, said housing including side walls interconnecting top and bottom walls, at least one of said top and bottom walls having a translucent portion, means carried by said walls for supporting said board away from said walls, electrically operated illuminating means within said housing electrically connected to the electrically conductive material on the upper and lower surfaces of the board, and connection means for connecting said surfaces to a source of electrical energy, said connection means including a clip extending through one of said side walls, said clip including a slot receiving said board and carrying a pair of conductors connected to an electrical source, one conductor being in contact with the electrically conductive material on one side of the board, the other conductor being in contact with the electrically conductive material on the other side of said board.

2. Lighting device as claimed in claim 1, wherein said board extends around said housing and defines an area bounded by said board, said illuminating device being mounted in said area.

3. Lighting device as claimed in claim 1, wherein said housing includes support means for supporting said board away from said walls.

4. Lighting device as claimed in claim 1, wherein said electrically conductive material is an electrically conductive coating on said upper and lower surfaces.

5. Lighting device comprising adjacent housings, an insulating board mounted in each of said housings having upper and lower surfaces carrying electrically conductive material, electrically operated illuminating means within each of said housings electrically connected to the electrically conductive material on the upper and lower surfaces of the board in each of said housings, means for connecting said surfaces to a source of electrical energy, means for securing said housings together, and electrically connecting means extending through the walls of said housings for electrically connecting the upper and lower surfaces of one of said insulative boards with the corresponding surfaces of the board mounted in another of said housings, said electrically connecting means including a clip extending through the walls of an adjacent portion of each of said housings, said clip including a pair of engaging portions, each of said engaging portions engaging the board mounted in a corresponding one of said housings, said clip having a pair of opposite ends, a slot in each of said ends for receiving a corresponding board, and a pair of electrical conductors extending through said slot, one of said conductors connecting with the conductive material on one side of each of said boards when the boards are received within their corresponding slot, the other conductor connecting with the conductive material on the other side of each of said boards.

6. Lighting device as claimed in claim 5, wherein one of said housings is rectangular and the other housing has more than four sides.

7. Lighting device as claim in claim 5, wherein one of said housings is rectangular and the other housing has a substantially flat side engaging one side of said one housing and a curved side extending from said flat side.

* * * * *